US006857482B2

(12) United States Patent
Comarmond

(10) Patent No.: US 6,857,482 B2
(45) Date of Patent: Feb. 22, 2005

(54) PERCUSSIVE IMPLEMENT OF THE ROCK BREAKER TYPE

(75) Inventor: Jean Sylvain Comarmond, Vourles (FR)

(73) Assignee: Etablissements Montabert, Saint Priest (FR)

( * ) Notice: Subject to any disclaimer, the term of this patent is extended or adjusted under 35 U.S.C. 154(b) by 112 days.

(21) Appl. No.: 10/258,114

(22) PCT Filed: May 9, 2001

(86) PCT No.: PCT/FR01/01403

§ 371 (c)(1),
(2), (4) Date: Nov. 22, 2002

(87) PCT Pub. No.: WO01/85398

PCT Pub. Date: Nov. 15, 2001

(65) Prior Publication Data

US 2004/0011542 A1 Jan. 22, 2004

(51) Int. Cl.[7] ..... B25D 17/00

(52) U.S. Cl. ..... 173/206; 173/129; 173/130; 173/132

(58) Field of Search ..... 173/129, 130, 173/132, 206; 279/97; 408/17

(56) References Cited

U.S. PATENT DOCUMENTS

| | | | | | |
|---|---|---|---|---|---|
| 3,097,859 A | * | 7/1963 | Sindelar | ..... | 279/97 |
| 3,390,897 A | * | 7/1968 | Moore | ..... | 285/33 |
| 3,841,672 A | * | 10/1974 | Schultz et al. | ..... | 285/148.21 |
| 3,945,653 A | | 3/1976 | Falchle | | |
| 3,954,276 A | | 5/1976 | Koniger et al. | | |
| 4,605,348 A | * | 8/1986 | DeCaro | ..... | 408/239 A |
| 5,000,631 A | * | 3/1991 | Deutschenbaur et al. | ... | 408/240 |
| 5,317,894 A | * | 6/1994 | Southard | ..... | 72/482.92 |
| 5,388,842 A | * | 2/1995 | Piras et al. | ..... | 279/19.5 |
| 5,820,312 A | * | 10/1998 | Stock et al. | ..... | 408/17 |
| 5,893,419 A | * | 4/1999 | Hodges | ..... | 173/13 |

FOREIGN PATENT DOCUMENTS

| | | |
|---|---|---|
| GB | 468737 | 7/1937 |
| GB | 969010 | 9/1964 |
| GB | 2 141 659 A | 1/1985 |

* cited by examiner

*Primary Examiner*—Scott A. Smith
*Assistant Examiner*—Nathaniel Chukwurah
(74) *Attorney, Agent, or Firm*—Oliff & Berridge, PLC

(57) ABSTRACT

The invention concerns an apparatus comprising a body (2) wherein a piston (6) is mounted sliding alternately driven by an incompressible fluid under pressure, said body containing part of a tool (4) which is guided in translation in a wear sleeve (3), the end of the tool located inside the body being subjected to the repeated impacts of the piston (6), while the other end projects beyond the body and is designed to be supported on the rock or analogue to be destroyed, the tool being retained in the body by at least a transverse key (13). One of the keys (13) retaining the tool passes through aligned holes provided in the body (2), into the wear sleeve (3), and overlaps inside the inner cylindrical space of the sleeve, the tool (4) having a transverse groove (12) for the key (13) to pass through.

4 Claims, 2 Drawing Sheets

PERCUSSIVE IMPLEMENT OF THE ROCK BREAKER TYPE

The subject of the present invention is a percussive implement of the rock breaker type comprising a body in which there is slidably mounted a piston driven back and forth by an incompressible fluid under pressure, this body containing part of a tool which is guided in translation in a wear sleeve, the end of the tool situated inside the body being subjected to the repeated blows of the piston while the other end protrudes from the body and is intended to bear against the rock or the like that is to be destroyed. Such an implement is intended to be carried by a machine, such as a mechanical shovel or bucket loader, for use in demolition or for breaking blocks in a quarry.

The wear sleeve or sleeves which guide the tool in translation are generally assembled in the body of the implement, either by diametral clamping or by keys, or alternatively are held captive between two parts of the body of the implement.

For its part, the tool is held in the axial direction of movement by one or more transverse keys entering a transverse keyway that the tool has, and in the bore of the lower part of the body of the implement, known as the front guide.

The body of the implement is, for its part, mounted in a chassis which allows the implement to be held on the carrying machine and to be protected from external knocks.

The chassis holds the body of the implement using conventional assembly means independent of those mentioned above.

In consequence, for lightweight percussive implements, such as rock breakers of under 500 kg, the cost associated with these various assembly means proves to be high.

The object of the invention is to provide a percussive implement of the rock breaker type, which has a simple structure and in which the main components are assembled simply and quickly.

To this end, in the implement to which it relates, of the aforementioned type, at least one of the tool-retaining keys passes through aligned holes made in the body, in the wear sleeve, and protrudes into the internal cylindrical space of the sleeve, the tool having a transverse slot for the passage of the key.

In consequence, the tool-retaining means are put to use to attach the wear sleeve in the body.

According to one feature of the invention, the sleeve has a through-notch perpendicular to the axis of the sleeve and extending over part of the periphery thereof.

In order to allow the tool sufficient travel, the distance between the upper shoulder of the sleeve forming a stop for the tool and the lower edge of the part of the key protruding into the sleeve is shorter than the distance between the end of the tool intended to bear against the shoulder and the edge of the groove situated toward the free end of the tool.

According to another feature of this implement, comprising a tubular chassis of circular or non-circular cross section inside which the body is mounted and which is equipped with means of attachment to a machine, the tubular chassis has through-holes corresponding to those made in the body to allow the passage of each assembly key which also passes through the sleeve, the body and holds the tool. The assembly means described above therefore also serve to fix the tubular chassis onto the body.

Advantageously, in order locally to strengthen the tubular part of the chassis, the latter comprises bosses in the regions in which the holes for the passage of each key emerge.

With a view to fixing each key, formed in the bosses are housings for fitting circlips for holding each key.

In any event, the invention will be clearly understood with the aid of the description which follows, with reference to the appended schematic drawing which, by way of non-limiting examples, depicts several embodiments of this implement:

Figure 1:
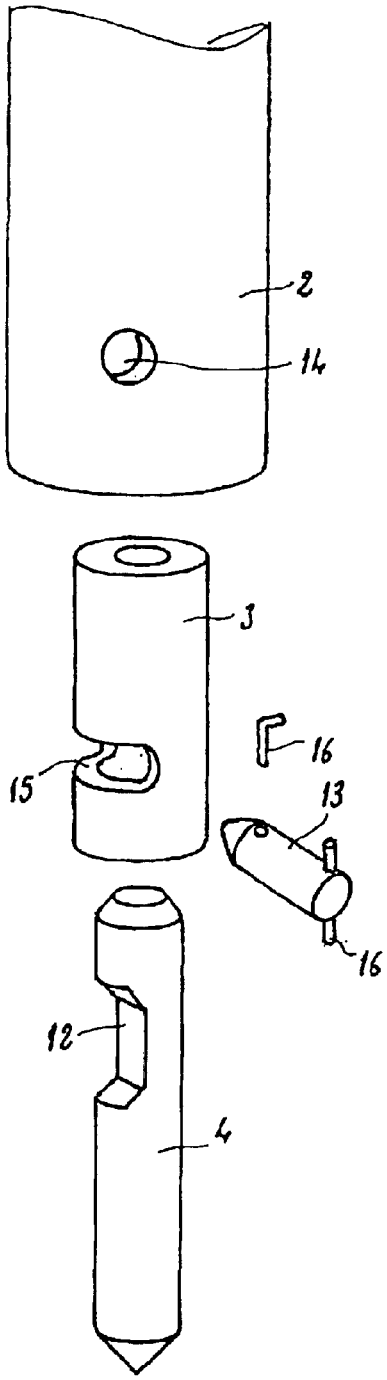
FIG. 1 is an exploded perspective view of a first implement.
Figure 2:
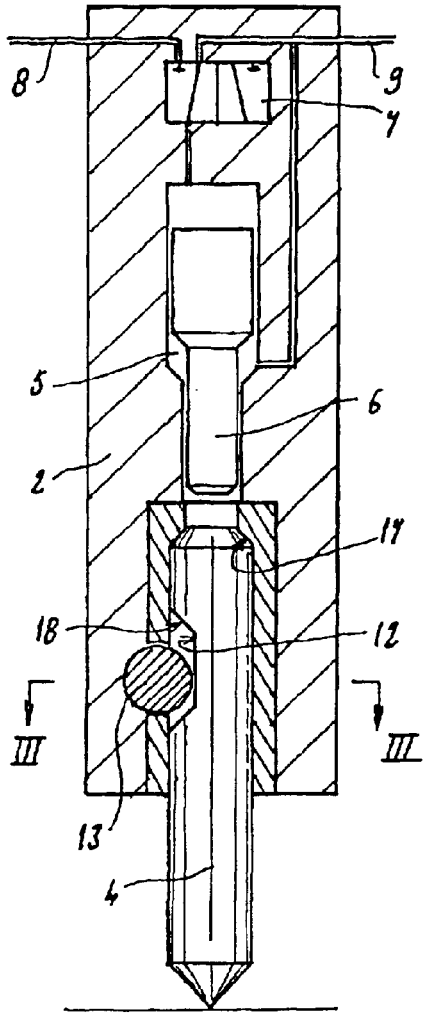
FIG. 2 is a view in longitudinal section in the assembled position.
Figure 3:
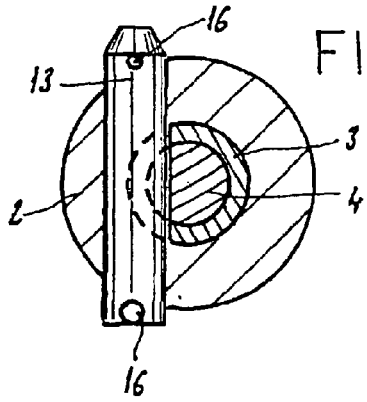
FIG. 3 is a view in cross section on III—III of FIG. 2.

FIGS. 1 to 3 depict a first implement comprising a body 2 equipped with a sleeve 3, inside which a tool 4 of circular cross section is slidably mounted. In its upper part, the body 2 comprises a bore 5 in which is slidably mounted a piston 6 the back and forth movement of which is performed by a hydraulic fluid directed by a directional control valve 7 connected to high-pressure 9 and low-pressure 10 pipes. As shown in FIGS. 1 to 3, the tool 4 comprises a keyway 12 in which is engaged a transverse key 13 which passes through two holes 14 made in the body 2, and a through-notch 15 made in the sleeve 3. This key can be held in place using pins 16. It should be noted that the dimension of the keyway 12 considered in the axial direction is greater than the diameter of the key 13. Furthermore, the distance between the shoulder 17 of the sleeve 3 forming a top stop for the tool and the lower edge of the part of the key 13 protruding into the sleeve is shorter than the distance between the end of the tool intended to bear against the shoulder 17 of the sleeve and the edge of the keyway 12 toward the free end of the tool.

In the bearing position depicted, it is possible to make the implement work under good conditions, the successive blows supplied by the piston 6 to the tool 4 being transmitted correctly to the material that is to be demolished.

When the implement is raised, for example during a phase of moving from one rock to another, the face 18 of the keyway 12 comes into contact with the key 13 to retain the tool 4 axially using the key.

The key 13 therefore has two roles; on the one hand, that of axially retaining the tool 4 when the implement is raised and, on the other hand, that of locking the sleeve 3 in the body 2.

Figure 4:
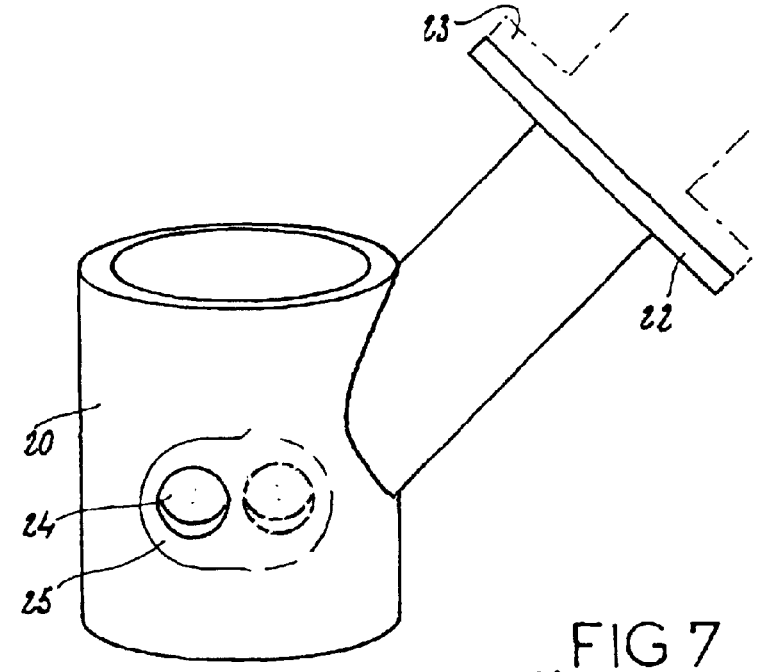
FIG. 4 is a perspective view of a tubular chassis for mounting the body of the implement of FIGS. 1 to 3.

FIG. 4 depicts a tubular chassis 20 inside which the body 2 is intended to be mounted. This chassis comprises a mounting plate 22 for fixing to a carrying machine the arm of which is denoted by the general reference 23. The chassis comprises two coaxial holes 24 opening at two bosses 25 which locally reinforce the tubular part of the chassis. These two holes 24 are used for the passage of the key 13 which already axially retains the tool 4 and fixes the sleeve 3 in the body 2.

Figure 5:
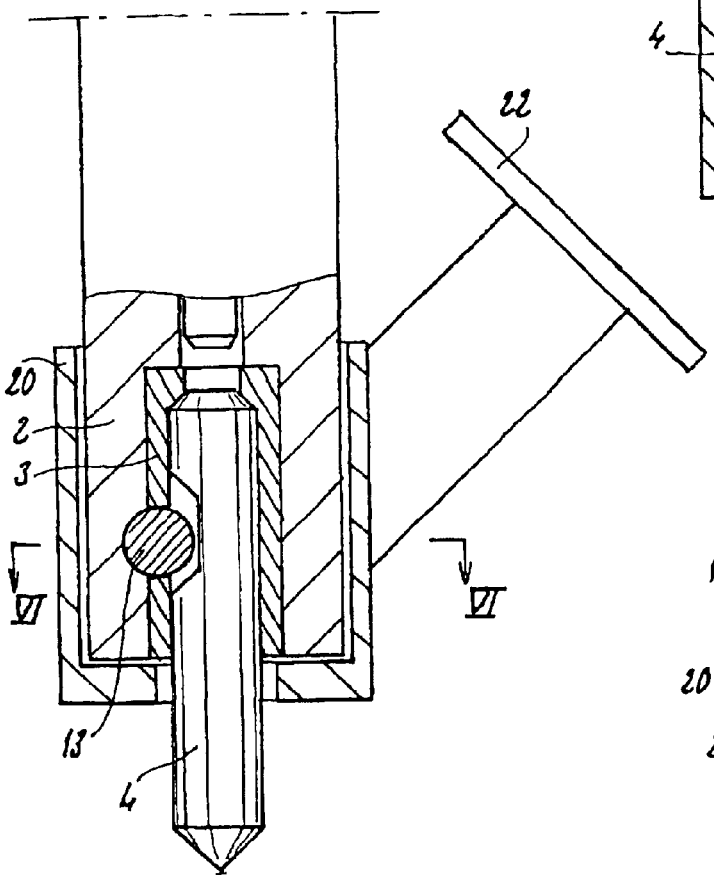
FIG. 5 is a view in longitudinal section of the implement mounted in the chassis of FIG. 4.
Figure 6:
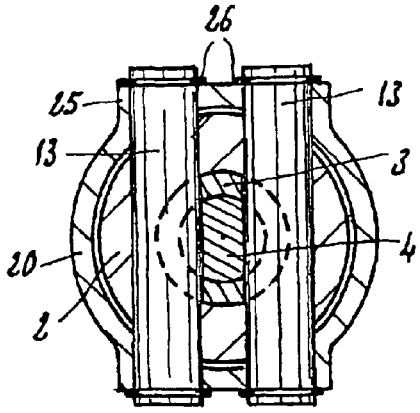
FIG. 6 is a view in cross section of another implement mounted inside the tubular chassis, this section view being on VI—VI of FIG. 5.

FIG. 6 depicts an alternative form of embodiment of this device, viewed in cross section on VI—VI of FIG. 5. In this case, the device comprises two keys 13 arranged symmetrically on each side of the tool 4, the latter then having two symmetric keyways 12. As shown in FIG. 6, housings are formed in the bosses 25 for circlips 26 for retaining the keys 13.

Figure 7:
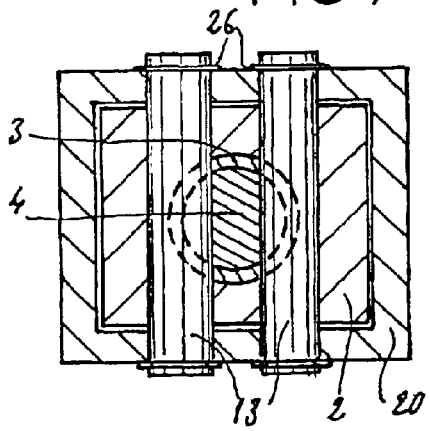
FIG. 7 is a view in cross section of another implement mounted inside a tubular chassis of non-circular cross section.

FIG. 7 depicts a device similar to that of FIG. 6, but in which the body 2 and the chassis 20 have a rectangular shape. The body 2 and the chassis 20 are prevented from rotating by the combination of the two rectangular shapes set one inside the other. The keys 13 prevent these two parts from rotating.

The number of keys 13 used is dependent on the geometry of the tool and on the power of the percussive implement.

As is evident from the foregoing, the invention provides a great improvement to the existing art by providing a percussive implement of the simple structure in which several components are assembled in a simple and quick way using keys which have several functions.

As goes without saying, the invention is not restricted to the sole embodiments of this device described hereinabove by way of example; on the contrary, it encompasses all alternative forms thereof. Thus, in particular, the chassis could be not tubular but made of braced plates, without that in any way departing from the scope of the invention.

What is claimed is:

1. A rock breaker type percussive implement comprising a body in which there is slidably mounted a piston driven back and forth by incompressible fluid under pressure, the body containing part of a tool which is guided in translation in a wear sleeve, one end of the tool situated inside the body being subjected to repeated blows of the piston while another end protrudes from the body and is intended to bear against an object that is to be destroyed, the tool being held in the body by at least one transverse key, wherein at least one tool-retaining key passes through aligned holes made in the body and in the wear sleeve, and protrudes into an internal cylindrical space of the sleeve, the tool having a transverse slot for passage of the key, the implement further comprising a tubular chassis inside which the body is mounted and which is equipped with means of attachment to a machine, the tubular chassis having through holes corresponding to the through holes made in the body to allow the passage of the at least one key, which also passes through the sleeve and the body, and holds the tool.

2. The percussive implement as claimed in claim 1, wherein the sleeve has a through-notch perpendicular to an axis of the sleeve and extending over part of a periphery thereof.

3. The percussive implement as claimed in claim 1, wherein the chassis comprises bosses in regions in which the holes for the passage of the at least one key emerge.

4. The percussive implement as claimed in claim 3, wherein housings are formed in the bosses for fitting circlips that hold the at least one key.

* * * * *